US006370507B1

(12) United States Patent
Grill et al.

(10) Patent No.: US 6,370,507 B1
(45) Date of Patent: Apr. 9, 2002

(54) FREQUENCY-DOMAIN SCALABLE CODING WITHOUT UPSAMPLING FILTERS

(75) Inventors: Bernhard Grill, Lauf; Bernd Edler, Hannover; Karlheinz Brandenburg, Erlangen, all of (DE)

(73) Assignee: Fraunhofer-Gesellschaft zur Foerderung der angewandten Forschung, e.V., Munich (DE)

( * ) Notice: Subject to any disclaimer, the term of this patent is extended or adjusted under 35 U.S.C. 154(b) by 0 days.

(21) Appl. No.: 09/319,066

(22) PCT Filed: Nov. 28, 1997

(86) PCT No.: PCT/EP97/06633

§ 371 Date: May 28, 1999

§ 102(e) Date: May 28, 1999

(87) PCT Pub. No.: WO98/37544

PCT Pub. Date: Aug. 27, 1988

(30) Foreign Application Priority Data

Feb. 19, 1997 (DE) ..... 197 06 516

(51) Int. Cl.[7] ..... G10L 19/02
(52) U.S. Cl. ..... 704/500; 704/205; 704/230
(58) Field of Search ..... 704/205, 230, 704/500

(56) References Cited

U.S. PATENT DOCUMENTS

| | | | | |
|---|---|---|---|---|
| 3,715,512 A | | 2/1973 | Kelly | 170/1 |
| 5,692,102 A | * | 11/1997 | Pan | 704/230 |
| 6,092,041 A | * | 7/2000 | Pan et al. | 704/229 |
| 6,094,636 A | * | 7/2000 | Kim | 704/500 |
| 6,108,625 A | * | 8/2000 | Kim | 704/229 |

FOREIGN PATENT DOCUMENTS

| | | |
|---|---|---|
| EP | 0578436 | 1/1994 |
| EP | 0770990 | 5/1997 |
| EP | 0805435 | 11/1997 |

OTHER PUBLICATIONS

Brandenburg et al., "First Ideas on Scalable Audio Coding," AES 97$^{th}$ Convention, Nov. 10–13, 1994, San Francisco.

* cited by examiner

*Primary Examiner*—Tālivaldis Ivars Šmits
(74) *Attorney, Agent, or Firm*—Michael A. Glenn

(57) ABSTRACT

In a method of coding discrete time signals ($X_1$) sampled with a first sampling rate, second time signals ($x_2$) are generated using the first time signals having a bandwidth corresponding to a second sampling rate, with the second sampling rate being lower than the first sampling rate. The second time signals are coded in accordance with a first coding algorithm. The coded second signals ($X_{2c}$) are decoded again in order to obtain coded/decoded second time signals ($X_{2cd}$) having a bandwidth corresponding to the second sampling frequency. The first time signals, by frequency domain transformation, become first spectral values ($X_1$). Second spectral values ($X_{2cd}$) are generated from the coded/decoded second time signals, the second spectral values being a representation of the coded/decoded time signals in the frequency domain. To obtain weighted spectral values, the first spectral values are weighted by means of the second spectral values, with the first and second spectral values having the same frequency and time resolution. The weighted spectral values ($X_b$) are coded in accordance with a second coding algorithm in consideration of a psychoacoustic model and written into a bit stream. Weighting the first spectral values and the second spectral values comprises the subtraction of the second spectral values from the first spectral values in to obtain differential spectral values.

15 Claims, 3 Drawing Sheets

FREQUENCY-DOMAIN SCALABLE CODING WITHOUT UPSAMPLING FILTERS

FIELD OF THE INVENTION

The present invention relates to methods of and apparatus for coding discrete signals and decoding coded discrete signals, respectively, and in particular to implementing differential coding for scalable audio coders in efficient manner.

BACKGROUND ART AND DESCRIPTION OF PRIOR ART

Scalable audio coders are coders of modular construction. There are endeavors to employ existing speech coders capable of processing signals, which are sampled e.g. with 8 kHz, and of outputting data rates of, for example, 4.8 to 8 kilobit per second. These known coders, such as e.g. the coders G.729, G.723, FS1016 and CELP known to experts, serve mainly for coding speech signals and in general are not suitable for coding higher-quality music signals since they are usually designed for signals sampled with 8 kHz, so that they can code only an audio bandwidth of 4 kHz at maximum. However, in general they exhibit faster operation and low calculating expenditure.

For audio coding of music signals, in order to obtain for example HIFI quality or CD quality, a scalable coder thus employs a combination of a speech coder and an audio coder that is capable of coding signals with a higher sampling rate, such as e.g. 48 kHz. It is of course also possible to replace the above-mentioned speech coder by a different coder, for example a music/audio coder according to the standards MPEG1, MPEG2 or MPEG3.

Such a cascade connection of a speech coder with a higher-grade audio coder usually employs the method of differential coding in the time domain. An input signal having e.g. a sampling rate of 48 kHz is downsampled to the sampling frequency suitable for the speech coder by means of a downsampling filter. The downsampled signal is then coded. The coded signal can be fed directly to a bit stream formatting means for transmission thereof. However, it contains only signals with a bandwidth of e.g. 4 kHz at maximum. The coded signal, furthermore, is decoded again and upsampled by means of an upsampling filter. However, due to the downsampling filter, the signal then obtained contains only useful information with a bandwidth of e.g. 4 kHz. Furthermore, it is to be noted that the spectral content of the upsampled coded/decoded signal in the lower band range up to 4 kHz does not correspond exactly to the first 4 kHz band of the input signal sampled with 48 kHz, since coders in general introduce coding errors (cf. "First Ideas on Scalable Audio Coding", K. Brandenburg, B. Grill, 97th AES-Convention, San Francisco, 1994, Preprint 3924).

As was already pointed out, a scalable coder comprises both a generally known speech coder and an audio coder that is capable of processing signals with higher sampling rates. In order to be able to transmit signal components of the input signal having frequencies above 4 kHz, a difference is formed of the input signal with 8 kHz and the coded/decoded upsampled output signal of the speech coder for each individual time-discrete sampled value. This difference then may be quantized and coded by means of a known audio coder, as known to experts. It is to be noted here that the differential signal fed into the audio coder capable of coding signals with higher sampling rates, is substantially zero in the lower frequency range, leaving apart coding errors of the speech coder. In the spectral range above the bandwidth of the upsampled coded/decoded output signal of the speech coder, the differential signal substantially corresponds to the true input signal at 48 kHz.

In the first stage, i.e. the stage of the speech coder, a coder with low sampling frequency is thus used mostly, since in general a very low bit rate of the coded signal is aimed at. At present, there are several coders, also the coders mentioned, operating with bit rates of a few kilobit (two to eight kilobit or also above). The same coders, furthermore, permit a maximum sampling frequency of 8 kHz, since a greater audio bandwidth is not possible anyway with such a low bit rate and since coding with a low sampling frequency is more advantageous as regards the calculating expenditure. The maximum possible audio bandwidth is 4 kHz and in practical application is restricted to about 3.5 kHz. In case a bandwidth improvement is to be achieved then in the additional stage, i.e. in the stage including the audio coder, this additional stage will have to operate with a higher sampling frequency.

For matching the sampling frequencies, decimation and interpolation filters are used for downsampling and upsampling, respectively. As FIR filters (FIR=Finite Impulse Response) are used in general for obtaining an advantageous phase behavior, filter arrangements of several hundred coefficients or "taps" can be required e.g. for matching from 8 kHz to 48 kHz.

SUMMARY OF THE INVENTION

It is the object of the present invention to provide methods of an apparatus for coding discrete signals and decoding coded discrete signals, respectively, which are capable of operating without complex upsampling filters.

This object is met by a method of coding according to claim 1, a method of decoding according to claim 13, an apparatus for coding according to claim 14, and an apparatus for decoding according to claim 15.

In accordance with a first aspect of the present invention, the object is met by a method of coding discrete first time signals sampled with a first sampling rate, by firstly generating second time signals, having a bandwidth corresponding to a second sampling rate, from the first time signals, with the second sampling rate being lower than the first sampling rate, secondly, coding the second time signals in accordance with a first coding algorithm in order to obtain coded second signals, third, decoding the coded second signals in accordance with the first coding algorithm in order to obtain coded/decoded second time signals having a bandwidth corresponding to the second sampling frequency, fourth, transforming the first time signals to the frequency domain to obtain first spectral values, fifth, generating second spectral values from the coded/decoded second time signals, the second spectral values being a representation of the coded/decoded second time signals in the frequency domain and having a time and frequency resolution substantially equal to the first spectral values, sixth, weighting the first spectral values with the second spectral values in order to obtain weighted spectral values which in number correspond to the number of the first spectral values, and coding the weighted spectral values in accordance with a second coding algorithm in order to obtain coded weighted spectral values.

Weighting the first spectral values and the second spectral values comprises the subtraction of the second spectral values from the first spectral values in to obtain differential spectral values.

In accordance with a second aspect of the present invention the above object is met by a method of decoding a coded discrete signal, by firstly decoding coded second signals to obtain coded/decoded second discrete time signals, with a first coding algorithm, secondly, decoding coded weighted spectral values with a second coding algorithm, to obtain weighted spectral values, thirdly, transforming the coded/decoded second discrete time signals to the frequency domain in order to obtain second spectral values, fourth, inversely weighting the weighted spectral values and the second spectral values to obtain first spectral values and retransforming the first spectral values to the time domain in order to obtain first discrete time signals.

In accordance with a third aspect of the present invention the above object is met by an apparatus for coding discrete first time signals sampled with a first sampling rate. The apparatus comprises several parts, such as, a generating device for generating second time signals, having a bandwidth corresponding to a second sampling rate, from the first time signals, with the second sampling rate being lower than the first sampling rate, a first coder for coding the second time signals in accordance with a first coding algorithm in order to obtain coded second signals, a decoder for decoding the coded second signals in accordance with the first coding algorithm in order to obtain coded/decoded second time signals having a bandwidth corresponding to the second sampling frequency, a transforming device for transforming the first time signals to the frequency domain to obtain first spectral values, a generating device for generating second spectral values from the coded/decoded second time signals, the second spectral values being a representation of the coded/decoded second time signals in the frequency domain and having a time and frequency resolution substantially equal to the first spectral values a weighting device for weighting the first spectral values with the second spectral values in order to obtain weighted spectral values which in number correspond to the number of the first spectral values, and a second coder for coding the weighted spectral values in accordance with a second coding algorithm in order to obtain coded weighted spectral values.

In accordance with a fourth aspect of the present invention the above object is met by an apparatus for decoding a coded time-discrete signal, comprising: a first decoder for decoding coded signals to obtain coded/decoded second discrete time signals, by means of a first coding algorithm; a second decoder for decoding coded weighted spectral values by means of a second coding algorithm, to obtain weighted spectral values; a transforming device for transforming the coded/decoded second discrete time signals to the frequency domain in order to obtain second spectral values; a weighting device for inversely weighting the weighted spectral values and the second spectral values to obtain first spectral values; and a transforming device for transforming the first spectral values to the time domain in order to obtain first discrete time signals.

An advantage of the present invention consists in that, with the apparatus for coding according to the invention (scalable audio coder), which comprises at least two separate coders, a second coder can operate in optimum marnner in consideration of the psychoacoustic model.

The invention is based on the realization that the upsampling filter involving much calculating time can be dispensed with when an audio coder or decoder, respectively, is employed which performs coding or decoding in the spectral range, and when the formation of the difference and, respectively, the formation of the inverse difference between the coded/decoded output signal of the coder or decoder of lower order and the original input signal, or the spectral representation of a signal based thereon, is carried out with a high sampling frequency in the frequency domain. It is thus no longer necessary to upsample the coded/decoded output signal of the coder of lower order by means of a conventional upsampling filter, but there are only two banks of filters necessary, namely one filter bank for just the coded/decoded output signal of the coder or lower order, and one filter bank for the original input signal with high sampling frequency.

Both of the filter banks mentioned deliver as output signals spectral values which are weighted by means of a suitable weighting means, which preferably is in the form of a subtracting means, in order to form weighted spectral values. These weighted spectral values then can be coded by means of a quantizer and coder in consideration of a psychoacoustic model. The data arising from quantizing and coding of the weighted spectral values can be fed to a bit formatting means preferably together with the coded signals of the coder of lower order, in order to be multiplexed in suitable manner, so that they can be transmitted or stored.

It is to be noted here that the savings in calculating time are in fact immense. In the afore-mentioned example, in which the speech coder processes signals sampled with 8 kHz and, furthermore, signals sampled with 48 kHz are to be coded, an upsampling FIR filter will require more than 100 multiplications per sampled value or sample, whereas a filter bank, which can be implemented by a MDCT as known to experts, requires merely ten to several ten (e.g. about 30) multiplications per sampled value.

It is to be pointed out here that with a scalable audio coder according to the present invention, the speech coder may also be replaced by an arbitrary coder according to the standards MPEG1 to MPEG3, as long as the two coders in the first and second stages are designed for two different sampling frequencies.

BRIEF DESCRIPTION OF THE DRAWINGS

Preferred embodiments of the present invention will be elucidated in more detail hereinafter with reference to the attached drawings in which.

DESCRIPTION OF PREFERRED EMBODIMENTS OF THE INVENTION

Figure 1:
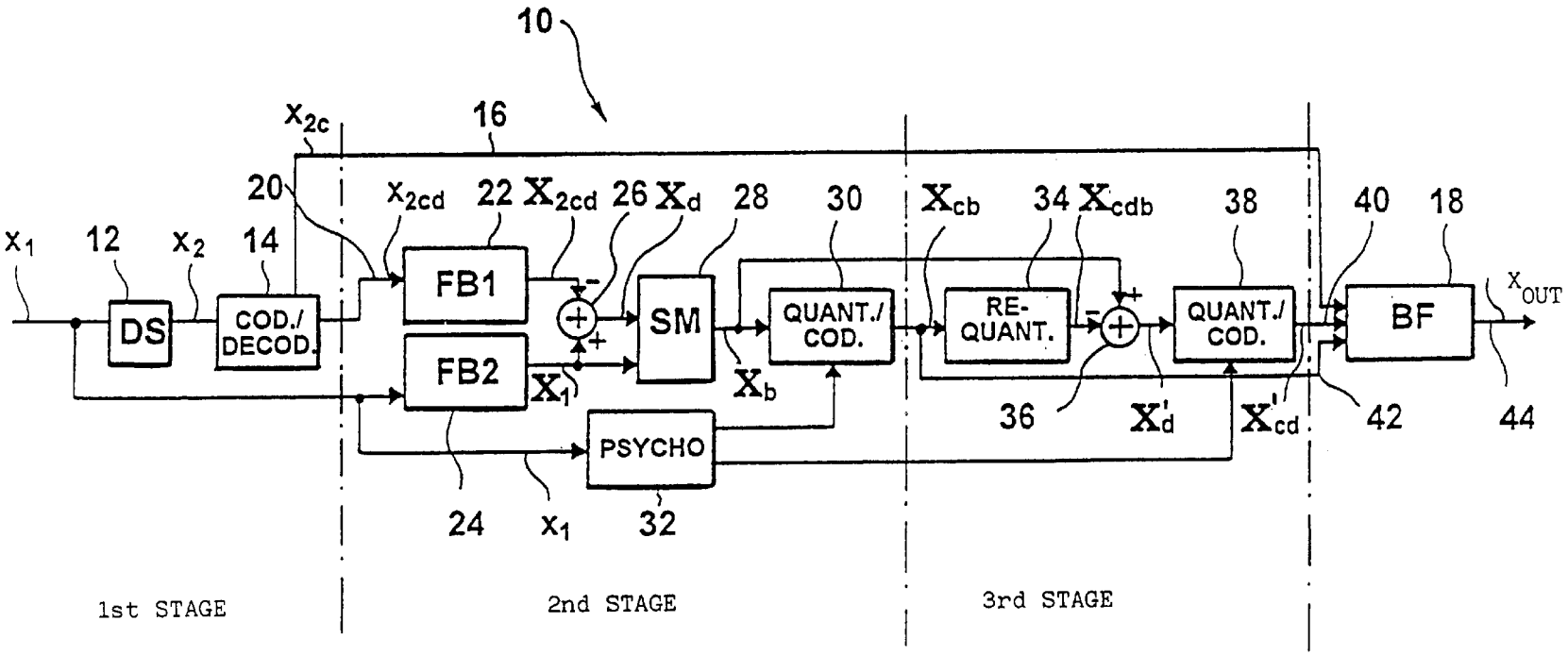
FIG. 1 shows a block diagram of an apparatus for coding according to the present invention.

FIG. 1 shows a principle block diagram of an apparatus for coding a time-discrete signal (of a scalable audio coder) according to the present invention. A discrete time signal $x_1$, sampled with a first sampling rate, e.g. 48 kHz, is brought to a second sampling rate, e.g. 8 kHz, by means of a downsampling filter 12, with the second sampling rate being lower than the first sampling rate. The first and second sampling rates preferably constitute a ratio of an integer. The output signal of the downsampling filter 12, which may be implemented as an decimation filter, is input to a coder/decoder 14 coding its input signal in accordance with a first coding algorithm. As was already mentioned, the coder/decoder 14 may be a speech coder of lower order, such as e.g. a coder G.729, G.723, FS1016, MPEG-4, CELP etc. Such coders operate with data rates from 4.8 kilobit per second (FS1016) to data rates of 8 kilobit per second (G.729). All of them process signals that have been sampled at a sampling frequency of 8 kHz. However, it is obvious to experts that arbitrary other coders may be employed that make use of other data rates and sampling frequencies, respectively.

The signal coded by coder 14, i.e. the coded second signal $x_{2c}$, which is a bit stream dependent on coder 14 and is present at one of the bit rates mentioned, is fed via a line 16 to a bit formatting means 18, with the function of the bit formatting means 18 being described later on. The downsampling filter 12 as well as the coder/decoder 14 constitute a first stage of the scalable audio coder according to the present invention.

The coded second time signals $x_{2c}$ output on line 16 furthermore are decoded again in the first coder/decoder 14 in order to generate coded/decoded second time signals $x_{2cd}$ on a line 20. The coded/decoded second time signals $x_{2cd}$ are time-discrete signals having a reduced bandwidth in comparison with the first discrete time signals $x_1$. In the numerical example mentioned, the first discrete time signal $x_1$ has a bandwidth of 24 kHz at maximum, since the sampling frequency is 48 kHz. The coded/decoded second time signals $x_{2cd}$ have a bandwidth of 4 kHz at maximum, since downsampling filter 12 has converted the first time signal $x_1$ by decimation to a sampling frequency of 8 kHz. Within the bandwidth from zero to 4 kHz, the signals $x_1$ and $x_{cd}$ are identical, apart from coding errors introduced by coder/decoder 14.

It is to be pointed out here that the coding errors introduced by coder 14 are not always small errors, but that these can easily reach orders of magnitude of the useful signal, for example when a highly transient signal is coded in the first coder. For this reason, an examination is carried out as to whether differential coding makes sense at all, as will be elucidated hereinafter.

Signals $x_{2cd}$ as well as signals $x_1$ are each fed into a filter bank FB1 22 and a filter bank FB2 24, respectively. Filter bank FB1 22 produces spectral values $X_{2cd}$ constituting a representation of the frequency domain of signals $x_{cd}$. In contrast thereto, filter bank FB2 produces spectral values $X_1$ constituting a representation of the frequency domain of the original, first time signal $x_1$. The output signals of both filter banks are subtracted in a summation means 26. More strictly speaking, the output spectral values $X_{2cd}$ of filter bank FB1 22 are subtracted from the output spectral values of filter bank FB2 24. Connected downstream of summation means 26 is a switching module SM 28 receiving as input signals both the output signal $X_d$ of summation means 26 and the output signal $X_1$ of filter bank 224, i.e. the spectral representation of the first time signals which will be referred to as spectral values $X_2$ in the following.

Switching module 28 feeds a quantization/coding means 30 carrying out quantization in consideration of a psychoacoustic model, as known to experts, which is shown in symbol by a psychoacoustic module 32. The two filter banks 22, 24, the summation means 26, the switching module 28, the quantizer/coder 30 and the psychoacoustic module 32 constitute a second stage of the scalable audio coder according to the present invention.

A third stage of the scalable audio coder of the present invention comprises a requantizer 34 which reverses the processing carried out by quantizer/coder 30. The output signal $X_{cdb}$ of requantizer 34 is fed into an additional summation means 36 with negative sign, whereas the output signal $X_b$ of switching module 28 is fed into the additional summation means 36 with positive sign. The output signal $X'_d$ of additional summation means 36 is quantized and coded by means of an additional quantizer/coder 38, in consideration of the psychoacoustic model present in psychoacoustic module 32, so that it also reaches the bit formatting means 18 on a line 40. Bit formatting means 18 receives furthermore the output signal $X_{cb}$ of first quantizer/coder 30. The output signal $x_{OUT}$ of bit formatting means 18, which is present on a line 44, comprises, as gatherable from FIG. 1, the coded second time signal $x_{2c}$, the output signal $X_{cb}$ of the first quantizer/coder 30 as well as the output signal $X'_{cd}$ of the additional quantizer/coder 38.

In the following, the operation of the scalable audio coder according to FIG. 1 shall be elucidated. The discrete, first time signals $x_1$ sampled with a first sampling rate, as was already mentioned, are fed into downsampling filter 12 in order to produce second time signals $x_2$ whose bandwidth corresponds to a second sampling rate, with the second sampling rate being lower than the first sampling rate. Coder/decoder 14 produces from the second time signals $x_2$ second coded time signals $x_{2c}$ according to a first coding algorithm, as well as coded/decoded second time signals $x_{2cd}$ by way of a subsequent decoding operation according to the first coding algorithm. The coded/decoded second time signals $x_{2cd}$ are transformed to the frequency domain by means of the first filter bank FB1 22, in order to produce second spectral values $X_{2cd}$ constituting a representation of the frequency domain of the coded/decoded second time signals $x_{2cd}$.

It is to be noted here that the coded/decoded second time signals $x_{2cd}$ are time signals having the second sampling frequency, i.e. 8 kHz in the example. The representation of the frequency domain of these signals and the first spectral values $X_1$ shall be weighted now, with the first spectral values $X_1$ being generated by means of the second filter bank FB2 24 from the first time signal $x_1$ having the first, i.e. high, sampling frequency. For obtaining comparable signals having an identical resolution as regards time and frequency, the 8 kHz signal, i.e. the signal having the second sampling frequency, has to be converted to a signal having the first sampling frequency.

This can be effected in that a specific number of zero values is introduced between the individual time-discrete sampled values of signal $x_{2cd}$. The number of zero values is calculated from the ratio between the first and second sampling frequencies. The ratio of the first (high) to the second (low) sampling frequency is referred to as upsampling factor. As known among experts, the introduction of zeros, which is possible with very low calculating expenditure, causes an aliasing error in signal $x_{2cd}$, which has the effect that the low-frequency or useful spectrum of signal $x_{2cd}$ is repeated, in total as many times as there are zeros introduced. The signal $x_{2cd}$ inflicted with the aliasing error then is transformed, by means of first filter bank FB1, to the frequency domain in order to produce second spectral values $X_{2cd}$.

By insertion of e.g. five zeros between each sampled value of the coded/decoded second signal $x_{2cd}$, a signal is formed of which it is known from the beginning that only every sixth sampled value of this signal is different from zero. This fact can be utilized in transforming this signal to the frequency domain by means of a filter bank or MDCT or by means of an arbitrary Fourier transform, since it is possible, for example, to dispense with specific summations occurring in a simple FFT. The preknown structure of the signal to be transformed thus can be used in advantageous manner for saving calculating time in a transformation of said signal to the frequency domain.

The second spectral values $X_{2cd}$ are only in the lower part a correct representation of the coded/decoded second time signal $x_{2cd}$, and this is why at the most only the fraction of 1/up-sampling factor of the entire spectral lines $X_{2cd}$ is used at the output of filter bank FB1. It is to be pointed out here that the number of spectral lines $X_{2cd}$ used, due to the insertion of zeros in the coded/decoded second time signal $x_{2cd}$, now has the same time and frequency resolution as the first spectral values $X_1$ which constitute a frequency representation of the first time signal $x_1$ without aliasing error. The two signals $X_{2cd}$ and $x_1$ are weighted in subtracting means 26 as well as in switching module 28, in order to create weighted spectral values $X_b$ or $X_1$. Switching module 28 then carries out a so-called simulcast-differential switching operation.

It is not always of advantage to employ differential coding in the second stage. This holds, for example, when the differential signal, i.e. the output signal of summation means 26, exhibits a higher energy than the output signal of the second filter bank $X_1$. Due to the fact that, furthermore, an arbitrary coder may be used for coder/decoder 14 of the first stage, it may happen that the coder produces specific signal components that are hard to code in the second stage. Coder/decoder 14 preferably is to maintain phase information of the signal coded by it, which among experts is referred to as "waveform coding" or "signal shape coding". The decision in switching module 28 of the second stage as to whether differential coding or simulcast coding is employed is made in dependence on frequency.

"Differential coding" means that only the difference of the second spectral values $X_{2cd}$ and the first spectral values $X_1$ is coded. However, if such differential coding is not expedient since the energy content of the differential signal is higher than the energy content of the first spectral values $X_1$, differential coding is refrained from. In case differential coding is refrained from, the first spectral values $X_1$ of time signal $x_1$, sampled with 48 kHz in the example, are connected through by switching module 28 and are used as output signal of switching module SM 28.

Due to the fact that the formation of the difference takes place in the frequency domain, it is easily possible to carry out a frequency-selective choice of simulcast or differential coding, as the difference between both signals $X_1$ and $X_{2cd}$ is calculated anyway. The difference formation in the spectrum thus permits a simple frequency-selective choice of the frequency domains to be subjected to differential coding. Switching over from differential coding to simulcast coding basically could take place for each spectral value individually. However, this will require a too great amount of side information and will not be absolutely necessary. It is therefore preferred to perform e.g. a comparison between the energies of the differential spectral values and the first spectral values in the form of frequency groups. As an alternative, it is possible to determine specific frequency bands from the very beginning, e.g. eight bands of 500 Hz width each, which again results in the bandwidth of signal $X_{2cd}$ when time signal $x_2$ has a bandwidth of 4 kHz. A compromise in determining the frequency bands consists in trading off the amount of side information to be transmitted, i.e. whether or not differential coding is active in a frequency band, against the benefits arising from as frequent differential coding as possible.

Side information, such as e.g. 8 bit for each band, an on/off bit for differential coding or also any other suitable coding, can be transmitted in the bit stream, with such information indicating whether or not a specific frequency band is differentially coded. In the decoder to be described later on, only the corresponding partial bands of the first coder will then be added correspondingly upon reconstruction.

A step of weighting the first spectral values $X_1$ and the second spectral values $X_{2cd}$ thus comprises preferably the subtraction of the second spectral values $X_{2cd}$ from the first spectral values $X_1$, in order to obtain differential spectral values $X_d$. Moreover, the energies of several spectral values in a predetermined band, for instance 500 Hz in the 8 kHz example, are calculated then in known manner, for example by summation and squaring, for the differential spectral values $X_d$ and for the first spectral values $X_1$. A frequency-selective comparison of the respective energies then is carried out in each frequency band. In case the energy in a specific frequency band of the differential spectral values $X_d$ exceeds the energy of the first spectral values $X_1$ multiplied by a predetermined factor k, a determination is made to the effect that the weighted spectral values $X_b$ are the first spectral values $X_1$. Otherwise, a determination is made to the effect that the differential spectral values $X_d$ are the weighted spectral values $X_1$. The factor k may have a value ranging from about 0.1 to 10, for example. With values of k lower than 1, simulcast coding is used already when the differential signal has a lower energy than the original signal. In contrast thereto, differential coding continues to be used with values of k greater than 1, even if the energy content of the differential signal is already greater than that of the original signal not coded in the first coder. When simulcast coding is weighted, switching module 28 will connect through the output signals of the second filter bank 24, so to speak directly. As an alternative to the difference formation described, it is also possible to carry out a weighting process such that e.g. a ratio or a multiplication or other linkage of the two signals mentioned is carried out.

The weighted spectral values $X_b$, which either are the differential spectral values $X_d$ or the first spectral values $X_1$, as determined by switching module 28, are now quantized by means of a first quantizer/coder 30 in consideration of the psychoacoustic model known to experts and provided in psychoacoustic model 32, and thereafter are coded preferably by means of redundancy-reducing coding using, for example, Huffman tables. As is known to experts furthermore, the psychoacoustic model is calculated from time signals, and this is why the first time signal $x_1$ with the high sampling rate is fed directly into psychoacoustic module 32, as shown in FIG. 1. The output signal $X_{cb}$ of quantizer/coder 30 is passed on line 42 directly to bit formatting means 18 and written into output signal $x_{OUT}$.

Hereinbefore a scalable audio coder having a first stage and a second stage has been described. According to an advantageous aspect of the invention, the inventive concept of the scalable audio coder is capable of cascading also more than two stages. Thus, it would be possible, for example, with an input signal $x_1$ sampled with 48 kHz, to code in the first coder/decoder 14 the first 4 kHz of the spectrum by reduction of the sampling rate, so as to obtain a signal quality after decoding which approximately corresponds to the speech quality of telephone calls. In the second stage, and by implementation by means of quantizer/coder 30, bandwidth coding of up to 12 kHz could be carried out in order to obtain a sound quality that approximately corresponds to HIFI quality. It is obvious to experts that a signal $x_1$ sampled with 48 kHz can have a bandwidth of 24 kHz. The third stage, by implementation by the additional quantizer/coder 38, then could carry out coding to a bandwidth of 24 kHz at maximum, or in a practical example of e.g. 20 kHz, in order to obtain a sound quality corresponding approximately to that of a compact disc (CD).

In implementing the third stage, the weighted signals $X_b$ at the output of switching module 28 are fed to the additional summation means 36. Furthermore, the coded weighted spectral values $X_{cb}$, which in the example now have a bandwidth of 12 kHz, are decoded again in requantizing means 34 in order to obtain coded/decoded weighted spectral values $X_{cdb}$ which in the example will also have a bandwidth of 12 kHz. By formation of the difference in the second summation means 36, additional differential spectral values $X'_d$ are calculated. The additional differential spectral values $X'_d$ may then contain the coding error of quantizer/coder 30 in the range from 4 kHz to 12 kHz as well as the full spectral contents in the range between 12 and 20 kHz when the example employed is carried on. The additional differential spectral values $X'_d$ then are quantized and coded in additional quantizer/coder 38 of the third stage, which in essence will be implemented in the same manner as the quantizer/coder 30 of the second stage and also is controlled by means of the psychoacoustic model, so as to obtain additional coded differential spectral values $X'_{cd}$ that may also be fed into bit formatter 18. The coded data stream $x_{OUT}$, in addition to the side information to be transmitted as well, now is composed of the following signals:

- the coded second signals $x_{2c}$ (full spectrum from 0 to 4 kHz);
- the coded weighted spectral values $X_{cb}$ (full spectrum from 0 to 12 kHz with simulcast coding or coding error from 0 to 4 kHz of coder 14 and full spectrum from 4 to 12 kHz with differential coding);
- the additional coded differential values $X'_{cd}$ (coding error from 0 to 12 kHz of coder/decoder 14 and of quantizer/coder 30 and full spectral contents from 12 to 20 kHz or coding error of quantizer/coder 30 from 0 to 12 kHz in case of simulcast mode and full spectrum from 12 to 20 kHz).

It is possible that transition interferences may occur at the transition from first coder/decoder 14 to quantizer/coder 30 in the example at the transition from 4 kHz to a higher value from 4 kHz. These transition interferences may manifest themselves in the form of erroneous spectral values written into bit stream $x_{OUT}$. The overall coder/decoder then can be specified such that e.g. only the frequency lines up to 1/upsampling factor minus x (x=1, 2, 3) are employed. This has the effect that the last spectral lines of the signal $X_{2cd}$ at the end of the maximum bandwidth reachable in accordance with the second sampling frequency are not taken into consideration. Thus, a weighting function is employed implicitly which, in the case mentioned, above a specific frequency value is zero and below the same has a value of one. As an alternative thereto, it is also possible to utilize a "softer" weighting function which effects an amplitude reduction of spectral lines displaying transition interference, whereupon the amplitude-reduced spectral lines are considered all the same.

It is to be pointed out here that the transition interferences are not audible sine they are eliminated again in the decoder. However, the transition interferences may result in excessive differential signals, for which the coding gain by differential coding is reduced then. By way of weighting with a weighting function as described hereinbefore, a loss of coding gain can thus be kept within limits. A different weighting function than the rectangular function will not require additional side information, since this function, just as the rectangular function, can be agreed upon from the very beginning for the coder and for the decoder.

Figure 2:
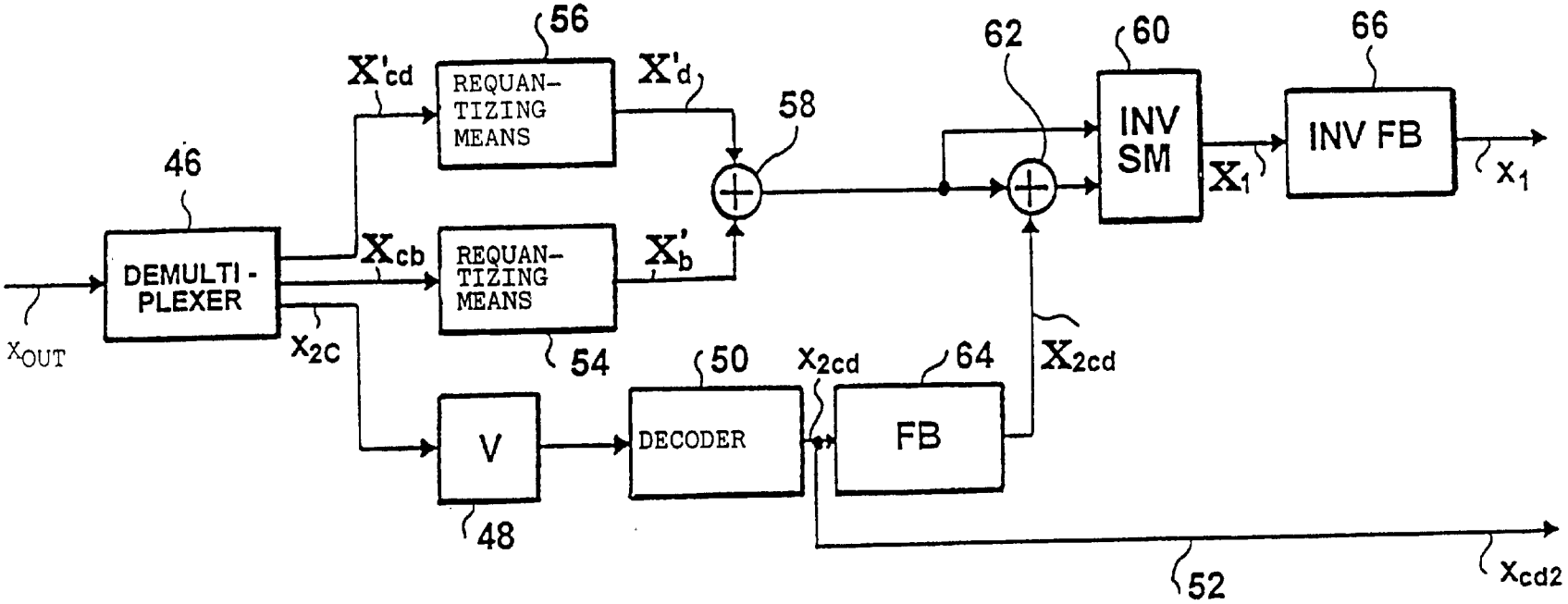
FIG. 2 shows a block diagram of an apparatus for decoding coded discrete time signals.

FIG. 2 shows a preferred embodiment of a decoder for decoding data coded by the scalable audio coder according to FIG. 1. The output data stream of bit formatter 18 of FIG. 1 is fed into a demultiplexer 46 in order to obtain from said data stream $x_{OUT}$ the signals present on lines 42, 40 and 16 with respect to FIG. 1. The coded second signals $X_{2c}$ are fed to a delay member 48, said delay member 48 introducing a delay into the data that may become necessary due to other aspects of the system and constitutes no part of the invention.

After the delay, the coded second signals $x_{2c}$ are fed into a decoder 50 which performs decoding by means of the first coding algorithm implemented also in coder/decoder 14 of FIG. 1, so as to produce the coded/decoded second time signal $x_{cd2}$ that can be output via a line 52, as can be seen in FIG. 2. The coded weighted spectral values $X_{cb}$ are requantized by means of a requantizing means 54, which may be identical with requantizing means 34, in order to obtain the weighted spectral values $X_b$. The additional coded differential values $X'_{cd}$, present on line 40 in FIG. 1, are also requantized by means of a requantizing means 56, which may be identical with requantizing means 54 and with requantizing means 34 (FIG. 1) in order to obtain additional differential spectral values $X'_d$. A summation means 58 establishes the sum of the spectral values $X_b$ and $X'_d$ which already correspond to the spectral values $X_1$ of the first time signal $x_1$ in case simulcast coding has been employed, as determined by an inverse switching module 60 on the basis of side information transmitted in the bit stream.

In case differential coding has been employed, the output signal of summation means 58 is fed into a summation means 60 in order to cancel the differential coding. When differential coding has been signalled to inverse switching module 60, this will block the upper input branch shown in FIG. 2 and connect through the lower input branch, so that the first spectral values $X_1$ are output.

It is to be pointed out here that, as can be seen from FIG. 2, the coded/decoded second time signal has to be transformed to the frequency domain by means of a filter bank 64 in order to obtain the second spectral values $X_{2cd}$ since the summation of summation means 62 is a summation of spectral values. Filter bank 64 preferably is identical with filter banks FB1 22 and FB2 24, so that only one means needs to be implemented which, when using suitable buffers, is fed successively with various signals. As an alternative, suitable different filter banks may be employed as well.

As was already mentioned, information used in quantizing spectral values are derived from the first time signal $x_1$ by means of psychoacoustic module 32. In particular, efforts are made, in the sense of minimizing the amount of data to be transmitted, to quantize the spectral values as coarsely as possible. On the other hand, interferences introduced by quantizing should not be audible. A known-per-se model present in psychoacoustic module 32 is employed for calculating a permissible interference energy which may be introduced by quantizing, so that no interference is audible. A control unit in a known quantizer/coder controls the quantizer in order to perform a quantizing operation introducing a quantizing interference which is smaller or equal to the permissible interference. This is continuously monitored in known systems in that the signal quantized by the quantizer, which is contained e.g. in block 30, is dequantized again. By comparison of the input signal in the quantizer with the quantized/dequantized signal, the interference energy actually introduced by quantizing is calculated. The actual interference energy of the quantized/dequantized signal is compared in the control unit to the permissible interference energy. When the actual interference energy is higher than the permissible interference energy, the control unit in the quantizer will adjust finer quantizing. The comparison between permissible and actual interference energy takes place typically for each psychoacoustic frequency band. This method is known and is used by the scalable audio coder according to the present invention when simulcast coding is employed.

In case differential coding has been determined, the known method cannot be employed, since no spectral values, but differential spectral values $X_b$, are to be quantized. The psychoacoustic model delivers permissible interference energies $E_{PM}$ for each psychoacoustic frequency band, which are not suitable for comparison with differential spectral values.

Figure 3:
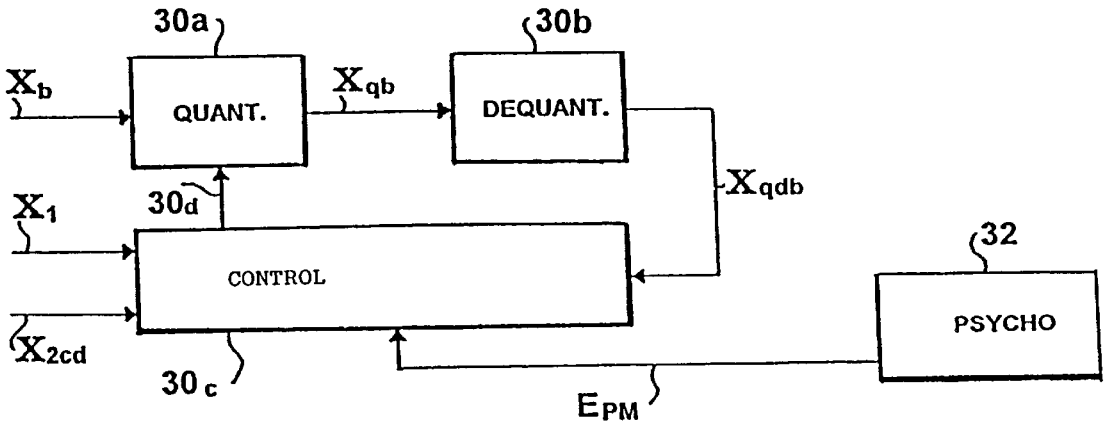
FIG. 3 shows a detailed block diagram of a quantizer/coder of FIG. 1.

FIG. 3 shows a detailed block diagram of quantizer/coder 30 or 38 of FIG. 1. The weighted spectral values $X_b$ are passed to a quantizer 30*a* delivering quantized weighted spectral values $X_{qb}$. The quantized weighted spectral values thereafter are inversely quantized in a dequantizer 30*b* in order to provide quantized/dequantized weighted spectral values $X_{qdb}$. The latter are fed into a control unit 30*c* receiving from psychoacoustic module 38 the permissible interference energy EPM per frequency band. Added to signal $X_{qdb}$, which represents differences, is signal $X_{2cd}$, so as to provide a signal comparable to the output of the psychoacoustic module. In control unit 30*c*, the actual interference energy $E_{TS}$ for a frequency band is calculated by. means of the following equation:

$$E_{TS}=\Sigma(X_1[i]-(X_{qdb}+X_{2cd}))^2$$

By way of a comparison of the actual interference energy $E_{TS}$ to the permissible interference energy $E_{PM}$, the control unit ascertains whether quantizing is too fine or too coarse, so as to adjust the quantizing process for quantizer 30*a* via a line 30*d* in such a manner that the actual interference is lower than the permissible interference. It is obvious to experts that the energy of a spectral value is calculated by squaring the same and that the energy of a frequency band is determined by adding the squared spectral values present in the spectral band. Furthermore, it is important to point out that the width of the frequency bands used in differential coding may differ from the width of the psychoacoustic frequency bands (i.e. frequency groups), which generally also is the case. The frequency bands used in differential coding are determined so as to obtain efficient coding, whereas the psychoacoustic frequency bands or frequency groups are determined on the basis of the observation by the human ear, i.e. the psychoacoustic model.

It is apparent to experts that the example given, in which the first sampling rate is 48 kHz and the second sampling frequency is 8 kHz, is merely of exemplary nature. It is also possible to use a lower frequency than 8 kHz for the second, lower sampling frequency. As sampling frequencies for the overall system, 48 kHz, 44.1 kHz, 32 kHz, 24 kHz, 22.05 kHz, 16 kHz, 8 kHz or any other suitable sampling frequency may be used. The bit rate range of coder/decoder 14 of the first stage may, as already mentioned, be from 4.8 kbit per second to 8 kbit per second. The bit rate range of the second coder in the second stage may be from 0 to 64, 69.659, 96, 128, 192 or 256 kbit per second with sampling rates of 48, 44.1, 32, 24, 16 and 8 kHz, respectively. The bit rate range of the coder of the third stage may be from 8 kbit per second to 448 kbit per second for all sampling rates.

What is claimed is:

1. A method of coding discrete first time signals sampled with a first sampling rate, said method comprising the following steps:

generating second time signals, having a bandwidth corresponding to a second sampling rate, from the first time signals, with the second sampling rate being lower than the first sampling rate;

coding the second time signals in accordance with a first coding algorithm in order to obtain coded second signals;

decoding the coded second signals in accordance with the first coding algorithm in order to obtain coded/decoded second time signals having a bandwidth corresponding to the second sampling frequency;

transforming the first time signals to the frequency domain to obtain first spectral values;

generating second spectral values from the coded/decoded second time signals, the second spectral values being a representation of the coded/decoded second time signals in the frequency domain and having a time and frequency resolution substantially equal to the first spectral values;

weighting the first spectral values by means of the second spectral values in order to obtain weighted spectral values which in number correspond to the number of the first spectral values, wherein the step of weighting includes forming a difference between the first spectral values and the second spectral values to obtain differential spectral values, deciding, whether differential coding or simulcast coding is to be performed, and determining the first spectral values as weighted spectral values when simulcast coding is to be performed, or determining the differential spectral values as weighted spectral values, when differential coding is to be performed; and coding the weighted spectral values in accordance with a second coding algorithm in order to obtain coded weighted spectral values.

2. The method of claim 1, wherein the step of generating the second spectral values comprises the following steps:

inserting a number of zero values between each discrete value of the coded/decoded second time signals, the number of zero values being equal to the ratio of the first to the second sampling frequency minus one, in order to obtain a modified,coded/decoded second signal;

transforming the modified, coded/decoded second signal to the frequency domain to obtain modified spectral values;

selecting a range of the modified spectral values for obtaining the second spectral values, with said range extending from the spectral value at the lowest frequency to the spectral value whose frequency value is substantially equal to the value of the bandwidth of the second time signal.

3. The method of claim 1, wherein the step of generating the second spectral values comprises the following steps:

inserting a number of zero values between each coded/decoded second time signals, the number of zero values being equal to the ratio of the first to the second sampling frequency minus one, in order to obtain a modified coded/decoded second signal;

calculating only a range of spectral values from the modified coded/decoded second signal, said range extending from the spectral value of the lowest frequency to the spectral value whose frequency is equal to the value of the bandwidth of the second time signal.

4. The method of claim 2 or 3, wherein a small number of spectral lines around the frequency corresponding to the value of the bandwidth of the second time signal is not selected or is weighted by means of a weighting function and selected thereafter.

5. The method of claim 1, wherein the step of weighting further comprises the following steps before the step of deciding:

calculating an energy of the differential spectral values;

calculating an energy of the first spectral values; and wherein the step of deciding includes the step of frequency selective comparing of the energies of the differential spectral values and the first spectral values and in case the energy of the differential spectral values exceeds the energy of the first spectral values multiplied by a factor k in a frequency section, with factor k being between 0.1 and 10, deciding that simulcast coding is to be performed, and otherwise, deciding that differential coding is to be performed.

6. The method of claim 5, wherein said frequency-selective comparison is carried out in the form of frequency groups.

7. The method of claim 1, wherein coding of the weighted spectral values according to the second coding algorithm is carried out in consideration of a psychoacoustic model.

8. The method of claim 7, wherein coding comprises the following steps:

calculating from the first time signal a permissible interference energy in a frequency band in consideration of the psychoacoustic model;

quantizing the weighted spectral values in the frequency band;

dequantizing the quantized weighted spectral values in the frequency band;

calculating the actual interference energy in the frequency band by means of the following equation:

$$E_{TS}=\Sigma(X_1[i]-(X_{qdb}+X_{2cd}))^2$$

wherein $X_1$ represents the first spectral values, represents the quantized/dequantized weighted spectral values, represents the second spectral values and i represents the summing index of a spectral value, with i encompassing the range from the first spectral value of the frequency band to the last spectral value of the frequency band;

comparing the actual interference energy to the permissible interference energy in the frequency band;

in case the actual interference energy is higher than the permissible interference energy in the frequency band, coding with finer quantizing in the frequency band; and otherwise, coding with coarser quantizing in the frequency band.

9. The method of claim 1, wherein coding in accordance with the second coding algorithm comprises Huffman coding for redundancy reduction.

10. The method of claim 1, comprising furthermore the following step:

formatting the coded second signals and the coded weighted signals in order to obtain a transmittable data stream.

11. The method of claim 10, comprising furthermore the following step:

formatting the coded second signals, the coded weighted spectral values and the coded additional differential spectral values in order to obtain a transmittable data stream.

12. The method of claim 1, which following the step of coding the weighted spectral values comprises the following steps:

decoding the weighted coded spectral values in order to obtain coded/decoded weighted spectral values;

subtracting the coded/decoded weighted spectral values from the weighted spectral values in order to obtain additional differential spectral values;

coding the additional differential spectral values in accordance with the second coding algorithm in order to obtain coded additional spectral values.

13. A method of decoding a coded discrete signal, comprising the following steps:

decoding coded second signals to obtain coded/decoded second discrete time signals, by means of a first coding algorithm;

decoding coded weighted spectral values by means of a second coding algorithm, to obtain weighted spectral values;

transforming the coded/decoded second discrete time signals to the frequency domain in order to obtain second spectral values; inversely weighting the weighted spectral values and the second spectral values to obtain first spectral values, wherein the step of inversely weighting includes:

determining, whether differential coding of simulcast coding was performed when generating the coded discrete signal; and in case it is determined that simulcast coding was performed, determining the weighted spectral values as the first spectral values, and, otherwise, forming the sum of the differential spectral values and the second spectral values to obtain the first spectral values; and retransforming the first spectral values to the time domain in order to obtain first discrete time signals.

14. An apparatus for coding discrete first time signals sampled with a first sampling rate, comprising:

a generating device for generating second time signals, having a bandwidth corresponding to a second sampling rate, from the first time signals, with the second sampling rate being lower than the first sampling rate;

a first coder for coding the second time signals in accordance with a first coding algorithm in order to obtain coded second signals;

a decoder for decoding the coded second signals in accordance with the first coding algorithm in order to obtain coded/decoded second time signals having a bandwidth corresponding to the second sampling frequency;

a transforming device for transforming the first time signals to the frequency domain to obtain first spectral values;

a generating device for generating second spectral values from the coded/decoded second time signals, the second spectral values being a representation of the coded/decoded second time signals in the frequency domain and having a time and frequency resolution substantially equal to the first spectral values;

a weighting device for weighting the first spectral values by means of the second spectral values in order to obtain weighted spectral values which in number correspond to the number of the first spectral values wherein the weighting device is arranged for forming a difference between the first spectral values and the second spectral values to obtain differential spectral values, deciding, whether differential coding or simulcast coding is to be performed, and determining the first spectral values as weighted spectral values when simulcast coding is to be performed, or determining the differential spectral values as weighted spectral values, when differential coding is to be performed; and a second coder for coding the weighted spectral values in accordance with a second coding algorithm in order to obtain coded weighted spectral values.

15. An apparatus for decoding a coded time-discrete signal, comprising:

a first decoder for decoding coded signals to obtain coded/decoded second discrete time signals, by means of a first coding algorithm;

a second decoder for decoding coded weighted spectral values by means of a second coding algorithm, to obtain weighted spectral values;

a transforming device for transforming the coded/decoded second discrete time signals to the frequency domain in order to obtain second spectral values;

a weighting device for inversely weighting the weighted spectral values and the second spectral values to obtain first spectral values wherein the weighting device is arranged for determining, whether differential coding of simulcast coding was performed when generating the coded discrete signal; and in case it is determined that simulcast coding was performed, determining the weighted spectral values as the first spectral values, and, otherwise, forming the sum of the differential spectral values and the second spectral values to obtain the first spectral values; and a transforming device for transforming the first spectral values to the time domain in order to obtain first discrete time signals.

* * * * *